US008573002B2

(12) United States Patent
Ledoux et al.

(10) Patent No.: US 8,573,002 B2
(45) Date of Patent: Nov. 5, 2013

(54) PORTABLE COOLER

(75) Inventors: Colette Ledoux, North Bay (CA); Raymond Mitchell, Montreal (CA); Claude Ledoux, North Bay (CA)

(73) Assignee: Colette Ledoux, North Bay, Ontario (CA)

( * ) Notice: Subject to any disclaimer, the term of this patent is extended or adjusted under 35 U.S.C. 154(b) by 998 days.

(21) Appl. No.: 12/463,753

(22) Filed: May 11, 2009

(65) Prior Publication Data

US 2010/0071395 A1 Mar. 25, 2010

Related U.S. Application Data

(60) Provisional application No. 61/100,016, filed on Sep. 25, 2008.

(51) Int. Cl.
*F25D 3/08* (2006.01)

(52) U.S. Cl.
USPC ..... 62/457.7; 62/457.1; 62/457.2; 62/457.5; 220/914; 220/23.87; 220/528; 220/529; 220/503; 220/505

(58) Field of Classification Search
USPC ..... 62/457.1, 457.2, 457.5, 457.7; 220/914, 220/23.87, 528, 529, 503, 505
See application file for complete search history.

(56) References Cited

U.S. PATENT DOCUMENTS

| | | | | |
|---|---|---|---|---|
| 2,823,971 | A * | 2/1958 | Hoyt | 312/290 |
| 4,236,657 | A * | 12/1980 | Brunton | 224/153 |
| 4,280,336 | A | 7/1981 | Taylor | |
| 5,004,134 | A * | 4/1991 | Barry | 224/650 |
| 5,062,557 | A * | 11/1991 | Mahvi et al. | 224/153 |
| D343,992 | S | 2/1994 | Melk | |
| D406,013 | S | 2/1999 | Yousko et al. | |
| D406,730 | S | 3/1999 | Freese et al. | |
| 6,237,765 | B1 | 5/2001 | Hagen et al. | |
| 6,279,707 | B1 * | 8/2001 | Godshaw et al. | 190/127 |
| D478,782 | S | 8/2003 | Li | |
| D585,705 | S | 2/2009 | Weers et al. | |
| 2002/0043076 | A1 | 4/2002 | Hodosh et al. | |
| 2005/0082298 | A1 | 4/2005 | Gano et al. | |

OTHER PUBLICATIONS

Official Letter of Pending Patent Application Under Examination dated Oct. 9, 2009 for Taiwanese Application No. 98300653 for "Cooler".
Office Action dated Jul. 15, 2010 received in co-pending Canadian Application No. 2,662,316.

* cited by examiner

*Primary Examiner* — Frantz Jules
*Assistant Examiner* — Azim Abdur Rahim
(74) *Attorney, Agent, or Firm* — Thomas C. McDonough; Neal, Gerber & Eisenberg LLP

(57) ABSTRACT

A portable cooler has a thermally isolating outer shell defining an internal compartment for holding contents to be kept cool, such as, for example, food, drinks and temperature-sensitive medicine. The portable cooler has a door connected to the outer shell for providing unrestricted access to the internal compartment. The portable cooler may have a shelf for holding a cold gel pack to help keep the contents cool. The cooler may also have a plurality of dividers (that are optionally reconfigurable) for defining variously sized storage spaces for the contents. The cooler may have an aesthetically pleasing curved outer shell and an adjustable shoulder strap so that the cooler can be carried on a person's shoulder. Because the cooler is easy and comfortable to carry and because its large swing-open door provides full and quick access to its contents, this cooler is more ergonomic and aesthetic than traditional designs.

15 Claims, 12 Drawing Sheets

PORTABLE COOLER

CROSS-REFERENCE TO RELATED APPLICATIONS

This application claims priority under 35 USC 119(e) from U.S. Provisional Patent Application 61/100,016 entitled PORTABLE COOLER filed Sep. 25, 2008.

TECHNICAL FIELD

The present invention relates, in general, to portable containers and, more particularly, to portable coolers that are used to keep food, drinks or other items cool.

BACKGROUND

A variety of plastic and Styrofoam coolers are widely available on the market for keeping one's food and drink cool for picnics, backyard barbeques, road trips, bringing home groceries in the summer, etc. Traditionally, these coolers are no more than an insulated box or other container that can be filled with ice, ice packs or cold gel packs to help keep the food and/or beverages cool. These traditional coolers may have handles to facilitate carrying or straps for wearing the cooler as a backpack. These traditional coolers, however, are typically large and unwieldy, not to mention aesthetically and ergonomically unrefined. These coolers are therefore ill-suited for persons wishing to bring food, drinks or temperature-sensitive medicine to work, to a meeting, to a conference, or other social setting where big, bulky and unaesthetic coolers would be inappropriate and appear out of place.

Also known in the art are a variety of portable refrigeration units. Portable refrigeration units that employ mechanical compressors are expensive, bulky, and require a substantial power source to drive the compressor. Portable cooling units that incorporate much smaller Peltier-effect cooling devices are also known but these also require a power source and are unduly expensive for the limited cooling capacity that they provide.

A need has therefore arisen for a portable cooler that is more ergonomic and aesthetic than traditional cooler designs and which does not require a power source.

SUMMARY

In general, the present invention provides a cooler having a thermally isolating outer shell. The outer shell defines an internal compartment for holding contents to be kept cool such as, for example, food, drinks, medicine, etc. The cooler has a door connected to the outer shell for providing access to the internal compartment.

In another aspect of the present invention, a detachable purse is detachably mounted to a top of the cooler. This purse-cooler combination enables a person to carry personal belongings in the purse such as, for example, keys, wallet, documents, cosmetics, cell phone, etc., while simultaneously carrying food, drinks or other items to be kept cool in the cooler.

Accordingly, the present invention provides an innovative portable cooler that is ergonomic, compact, aesthetic and requires no power, and thus represents an improvement over pre-existing cooler designs.

This novel portable cooler can be shaped like a shoulder bag, purse, backpack, suitcase, or any other form. The cooler can be made to have a visually pleasing curved outer shell that is not only aesthetic but also ergonomic and comfortable since the curved outer shell fits perfectly over the wearer's hip when the shoulder strap is worn on the shoulder.

The cooler has a large pivoting (or hinged) door that can be swung fully open to provide unrestricted access to various compartments and shelves inside the cooler. Specific food containers, boxes, cans, bottles, etc. can thus be accessed directly without having to rummage around, as is commonly the case with traditional coolers where items can get buried at the bottom.

An optional top shelf can be provided in certain embodiments for holding a gel pack (or equivalent) that provides cooling for the contents of the cooler. This gel pack can be frozen or cooled prior to usage. Due to the double hull construction of the outer shell, and optional foam liner, the contents remain cool for a long period of time, thus obviating the need to use a cooling device that requires a power source. By placing the cold gel pack on the dedicated top shelf, the contents are optimally cooled since the cold air will tend to descend over the contents located beneath the gel pack. The dedicated top shelf provides the minimal space for the gel pack to optimize the amount of space for the food and beverages. Optionally, the dedicated top shelf (and/or the other shelves or compartment walls) may have holes, apertures or be made of a mesh or screen to facilitate circulation of cold air from the gel pack to the contents of the cooler. In some embodiments, these shelves and walls ("dividers") can also be reconfigurable so that the user can customize the internal compartment to optimally store differently shaped items.

BRIEF DESCRIPTION OF THE DRAWINGS

Further features and advantages of the present invention will become apparent from the following detailed description, taken in combination with the appended drawings, in which.

It should be noted that throughout the appended drawings, like features are identified by like reference numerals. The drawings are not necessarily to scale.

DETAILED DESCRIPTION

Figure 1:
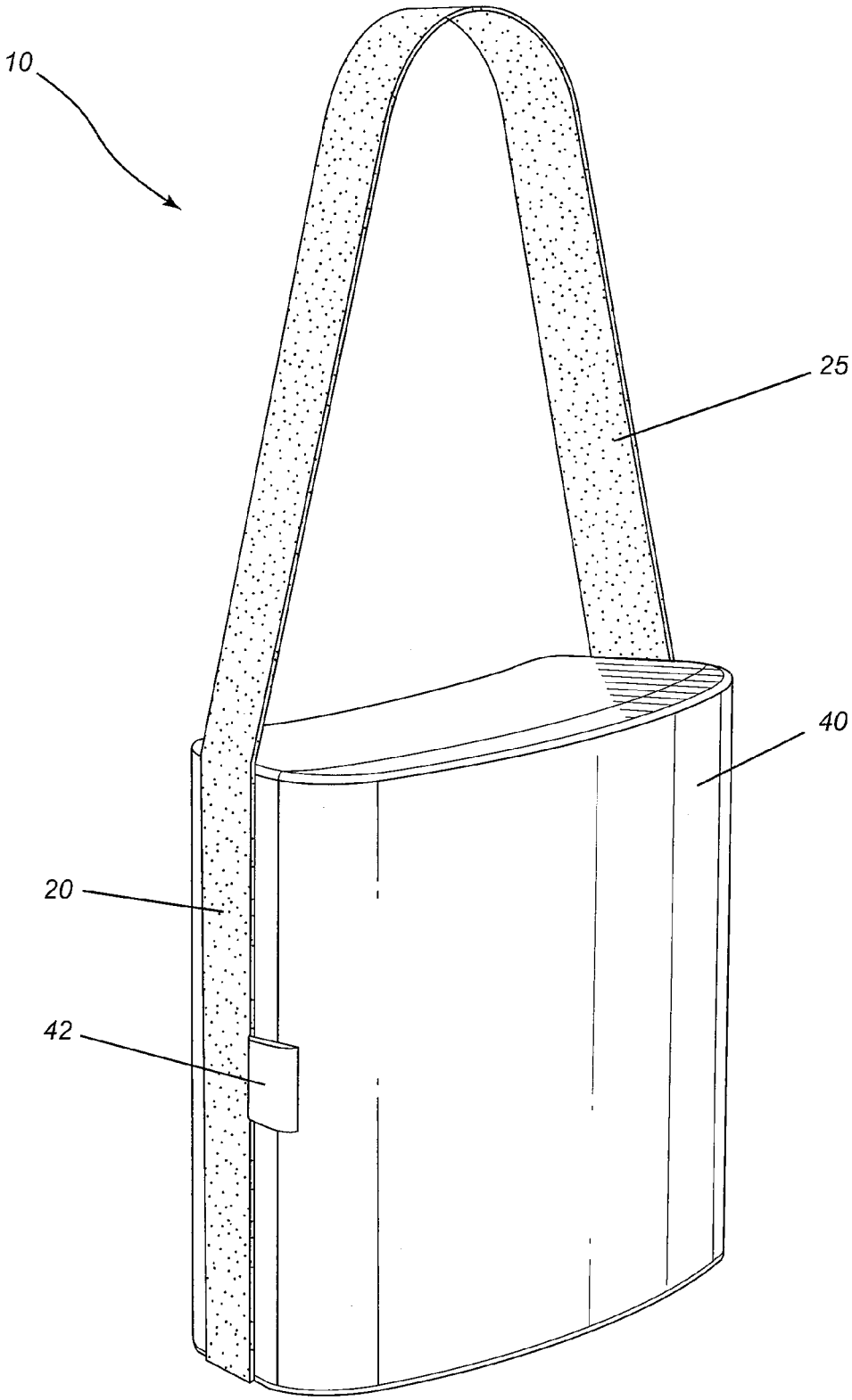
FIG. 1 is a perspective view of a cooler in accordance with an embodiment of the present invention.
Figure 2:
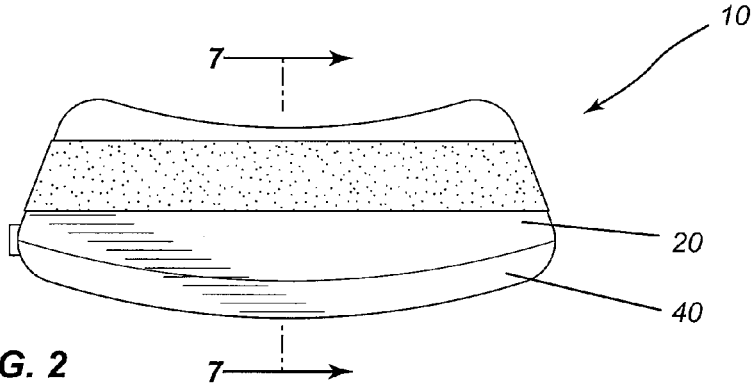
FIG. 2 is a top plan view of the cooler of FIG. 1.
Figure 3:
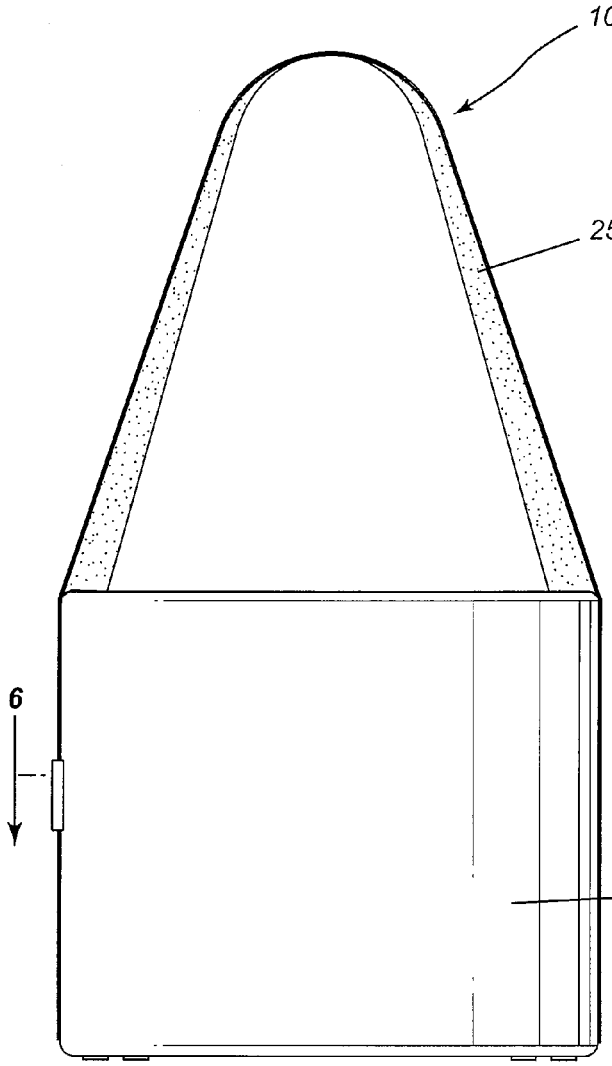
FIG. 3 is a front elevation view of the cooler of FIG. 1.
Figure 4:
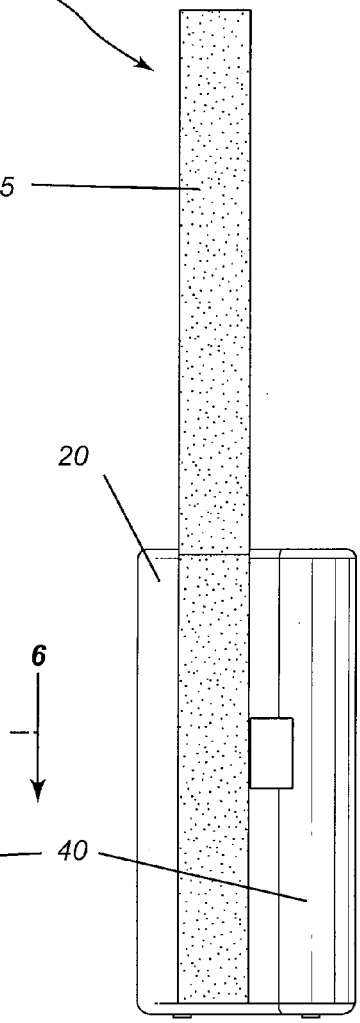
FIG. 4 is a side elevation view of the cooler of FIG. 1.

In general, and as will be elaborated below, the present invention provides an innovative cooler and an innovative purse-cooler combination. Both the cooler and the purse-cooler combination are ergonomically and aesthetically designed to provide altogether new product that can be used in a variety of settings where traditional coolers would seem inappropriate.

Embodiments of this invention will now be described in greater detail below, with reference to the accompanying figures.

Overview

By way of overview, FIGS. 1 to 8 depict a first embodiment of the present invention, namely a shoulder-carried cooler having a door that swings open to provide full access to a subdivided internal compartment.

FIGS. 9 to 16 depict a second embodiment of the present invention, namely a purse-cooler combination in which a detachable purse is detachably mounted to a top of the cooler.

FIGS. 17 to 24 depict a third embodiment of the present invention, namely an elongated cooler that is specially adapted for carrying beverage bottles.

These three main embodiments are presented merely to exemplify various interesting and innovative aspects of the invention, and are not intended to limit the scope of the invention. As will become apparent from this disclosure, there are many possible variations on the embodiments presented herein. For example, while this cooler is depicted as having a generally purse-like outer shell that can be worn using a shoulder strap, this cooler can also be incorporated within, or designed to function as, a handbag, bag, lunchbox, backpack, suitcase (or other piece of luggage), briefcase, attaché case, or any other portable container.

In each of the embodiments depicted, the thermally isolating outer shell is curved for ergonomically fitting over a hip of a user when the cooler is worn on a shoulder of the user. In these embodiments, the door is also curved to match the curved outer shell. The cooler can also be designed without this curved body or curved outer shell.

Each of these embodiments therefore provides a cooler or purse-cooler combination can be used in a variety of settings and for a number of different applications, e.g. for carrying one's lunch to work, to school, to a conference, to a sports event, on a picnic, on a trip, etc. Depending on the specific application that is envisaged, the shape, color, texture, and finish of the outer shell can be varied. Thus, irrespective of its shape, the exterior finish of the outer shell of the cooler can vary (for any of the embodiments) from hard-shelled (plastic, metal, composite material, etc) to soft-covered (leather or suede) or padded or rubberized (e.g. foamed or rubber shell etc), or any combination thereof. In other words, the outer shell can be any hardness, color, surface finish, etc.

First Embodiment: Cooler

In the first embodiment depicted in FIGS. 1 to 8, a cooler, which is generally designated by reference numeral 10, has a thermally isolating outer shell 20 (shown in FIGS. 1-4). The shell defines an internal compartment 30 (shown in FIG. 5) for holding contents to be kept cool. These contents can include, for example, food, drinks, medicine, etc. The shell 20 can be a double-shelled structure comprising an interior cavity between the double shells that thermally isolates the contents (e.g. food, drinks, medicines, etc.) from the environment. This cavity can optionally be filled with a thermally isolating foam.

Figure 5:
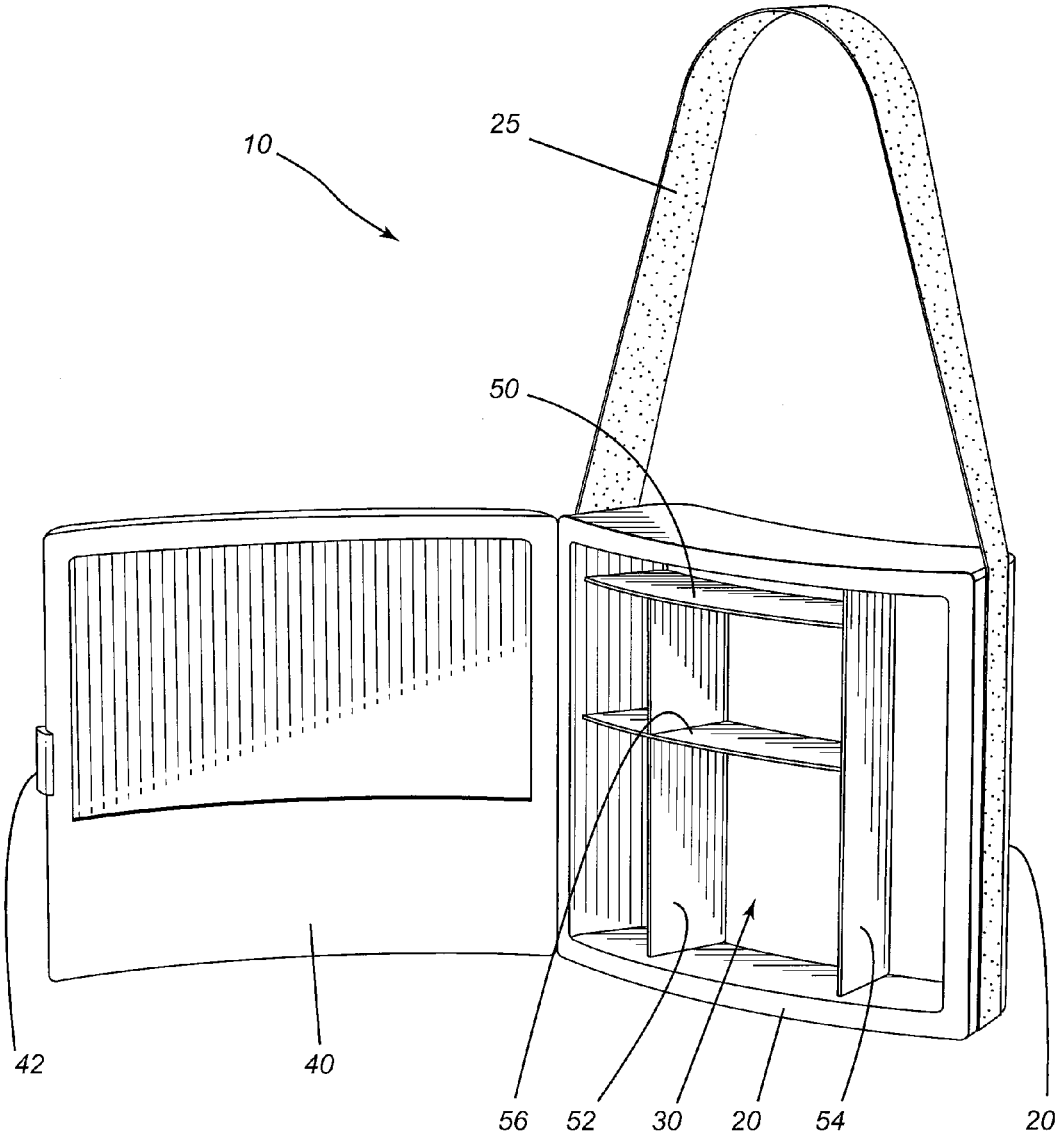
FIG. 5 is a perspective view of the cooler of FIG. 1, depicted with the door open, revealing the interior compartments of the cooler.
Figure 6:
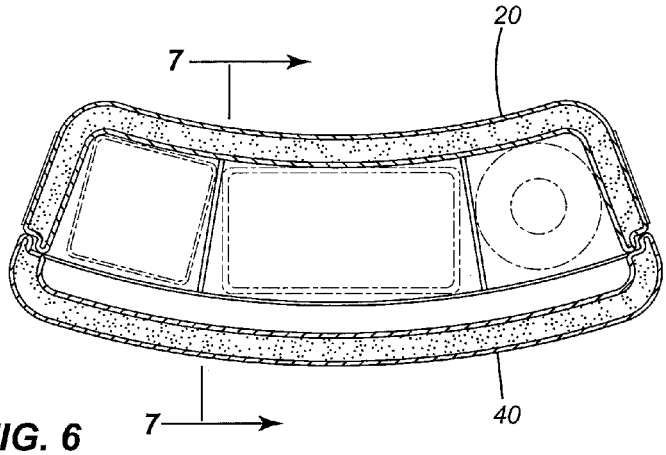
FIG. 6 is a cross-sectional view of the cooler of FIG. 1, taken through section 6-6 of FIG. 3.
Figure 7:
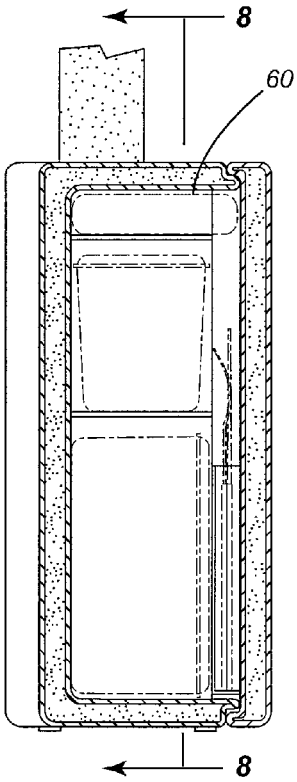
FIG. 7 is a cross-sectional view of the cooler of FIG. 1, taken through section 7-7 of FIG. 2.
Figure 8:
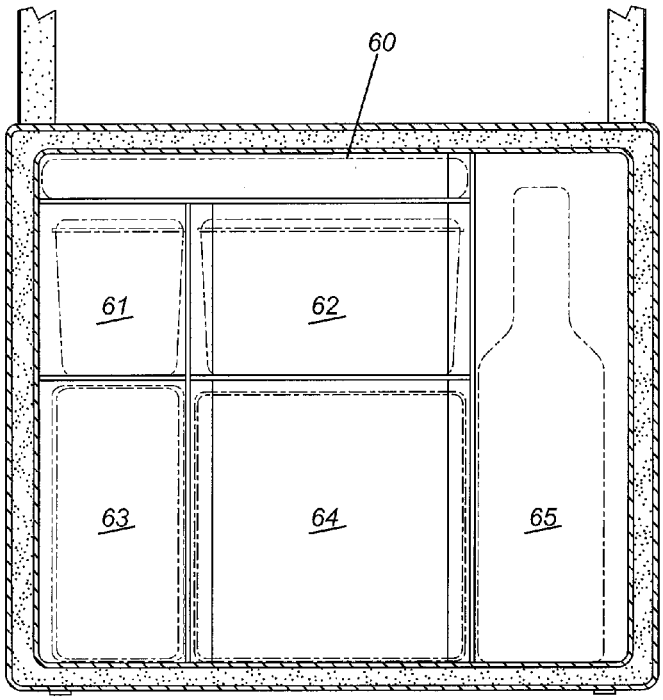
FIG. 8 is a partial cross-sectional view showing the interior compartment of the cooler of FIG. 1 loaded with various food containers, a bottle, and a gel pack, the containers, bottle and gel pack being illustrated in stippled lines.
Figure 9:
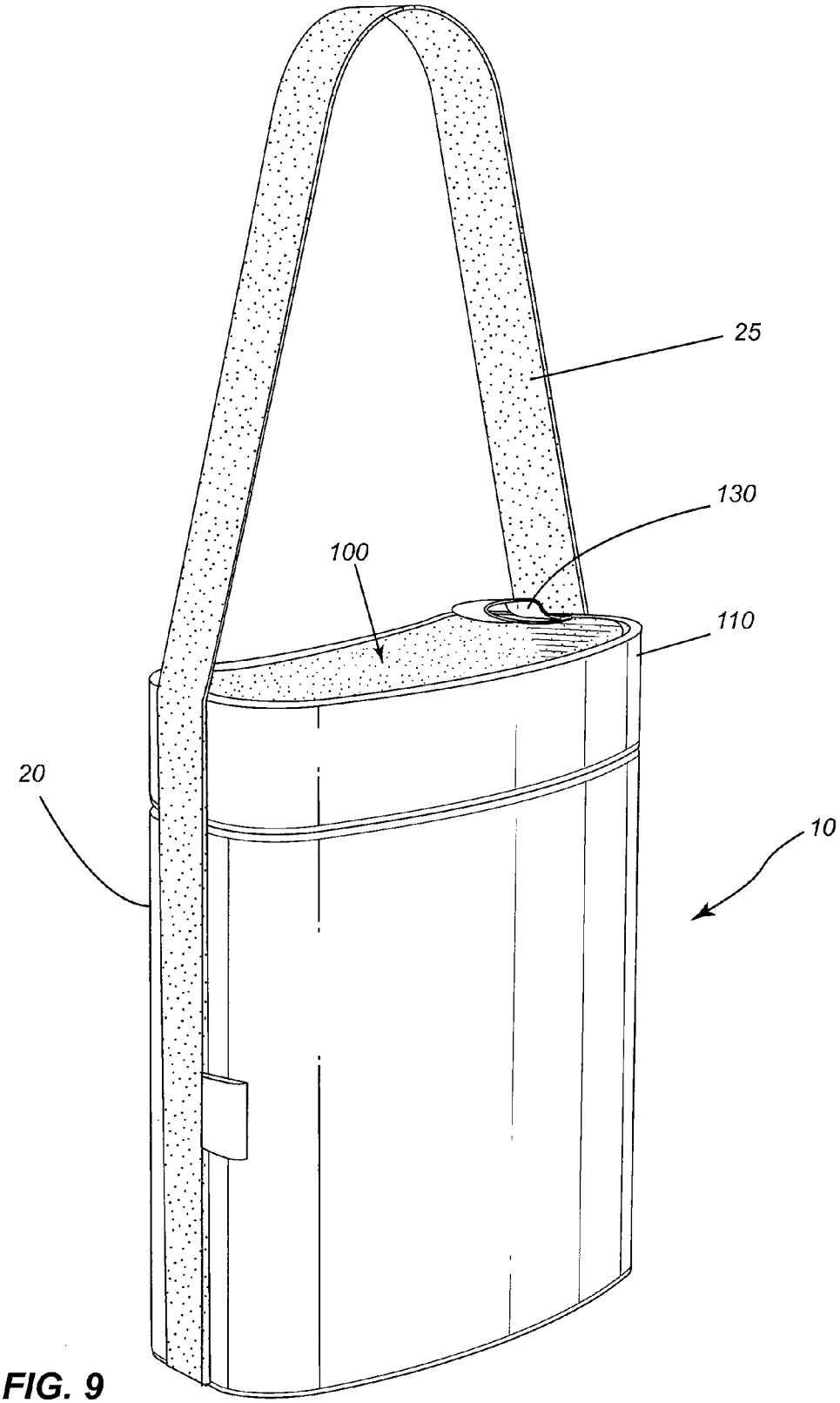
FIG. 9 is a perspective view of a cooler in accordance with another embodiment of the present invention in which a purse is detachably mounted atop the cooler.
Figure 10:
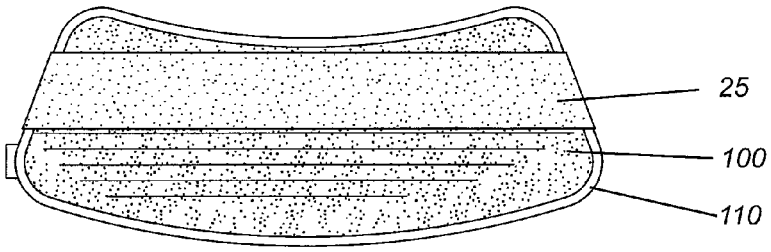
FIG. 10 is a top plan view of the cooler-purse combination shown in FIG. 9.
Figure 11:
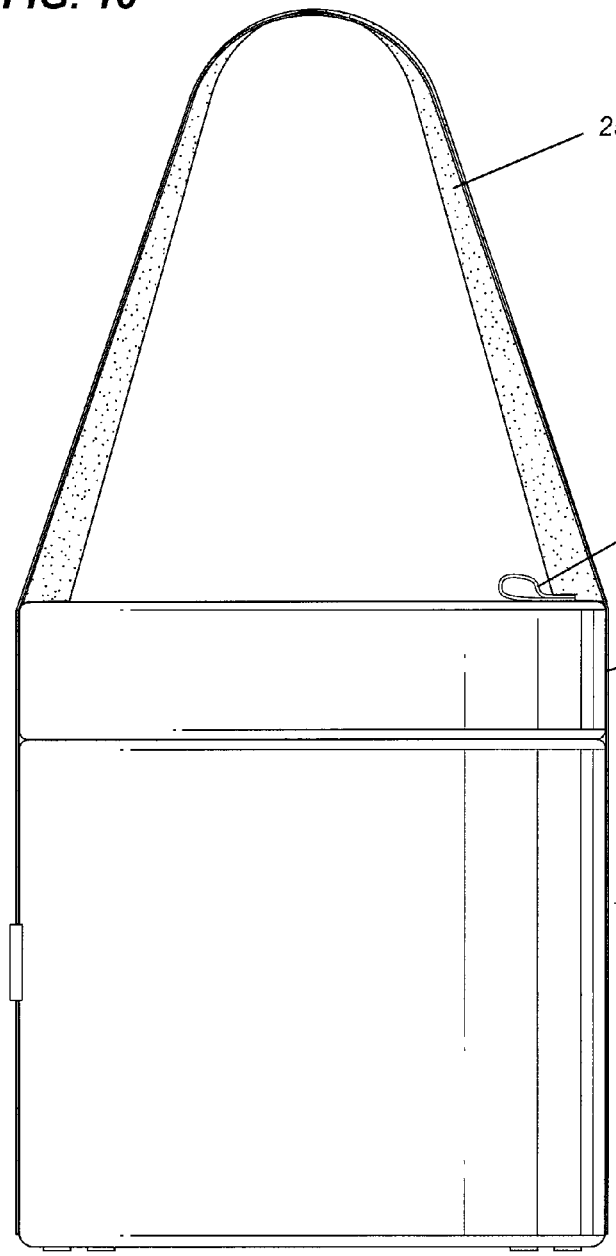
FIG. 11 is a front elevation view of the cooler-purse combination shown in FIG. 9.
Figure 12:
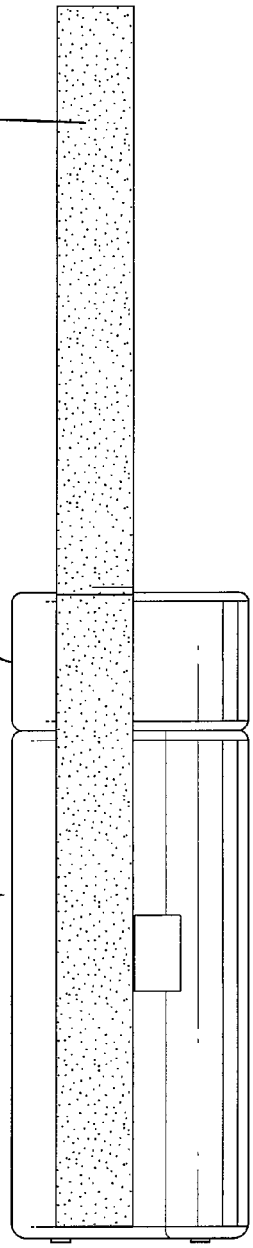
FIG. 12 is a side elevation view of the cooler-purse combination shown in FIG. 9.

As shown in FIGS. 1-8, the cooler includes a door 40 connected to the outer shell 20 for providing access to the internal compartment 30. The door 40 of the cooler can be made to swing fully open. The door can be connected by hinges or pivots. The door can swing open about a substantially vertical axis. In other arrangements, it could be possible to make the door swing about another axis (e.g. a substantially horizontal axis). The door swings open to provide full access to the contents (food, drink, etc.) which are stored or held in various internal compartments and/or on various shelves. The door can be locked or clipped shut using a locking clip 42, as shown in FIGS. 1 and 5, or by any other suitable locking means known in the art.

As further depicted in FIGS. 1-8, the cooler includes a shoulder strap 25, although any other strap, handle, grip, harness, etc. may be provided so that the cooler can be carried or worn in various manners, such as, for example, as a shoulder-carried purse, a handbag, backpack, etc.

As depicted by way of example in FIG. 5, the internal compartment may have a top shelf 50 for holding a gel pack 60 (shown in FIGS. 7 and 8) and a plurality of dividers (e.g. vertical dividers 52, 54 and horizontal divider/shelf 56) defining a plurality of compartments beneath the top shelf 50. One or more straps, elastic retaining bands, or mesh retaining nets (not shown) can be provided to restrain items in their respective internal compartments and/or on the shelves.

In the embodiment depicted in FIGS. 1-8, the internal compartment is subdivided in an arrangement designed to accommodate, for example, various boxes or food containers. As shown in stippled lines in FIGS. 6-8, a plurality of boxes or food containers 61,62,63,64 and an upright bottle 65 can be carried in this particular version of the cooler. The upper ledge or top shelf 50 is provided for holding a gel pack 60, ice pack, or other cold object that provides the cooling for the rest of the contents. Placing the gel pack or ice pack on the top shelf optimizes the cooling of the contents beneath as the cold air will descend from the gel pack or ice pack.

In a variant, the internal compartment may have a plurality of reconfigurable dividers that can be repositioned to provide a plurality of different configurations for holding variously sized contents. These reconfigurable dividers can be both vertical dividers (walls) or horizontal dividers (shelves). These reconfigurable dividers can be repositioned using support pins or removable plugs that can be slotted into preformed holes spaced at fixed intervals on the inside wall, interlocking dividers, removable fasteners, Velcro™, or other suitable mechanical connectors known in the art.

In one embodiment, as shown by way of example in FIGS. 1-8, the thermally isolating outer shell is curved for ergonomically fitting over a hip of a user when the cooler is worn on a shoulder of the user. The door can also be curved to match the curved outer shell. The resulting cooler is both ergonomic (e.g. comfortable to wear and to carry on one's shoulder) and aesthetic (thus enabling it to be used in a variety of social settings where traditional coolers would be inappropriate).

Second Embodiment: Purse-Cooler Combination

In the second embodiment, as depicted in FIGS. 9-16, a purse-cooler combination 10, 100 comprises a cooler 10 (substantially similar to the one presented above) having an outer shell 20 defining an internal compartment 30 and a door 40 connected to the outer shell 20 for providing access to the internal compartment 30. The purse-cooler combination 10,100 further includes a detachable purse 100 detachably mounted to the cooler 10. As depicted by way of example in FIGS. 9-16, the purse can be mounted atop the cooler, which is the optimal location for the purse.

Figure 13:
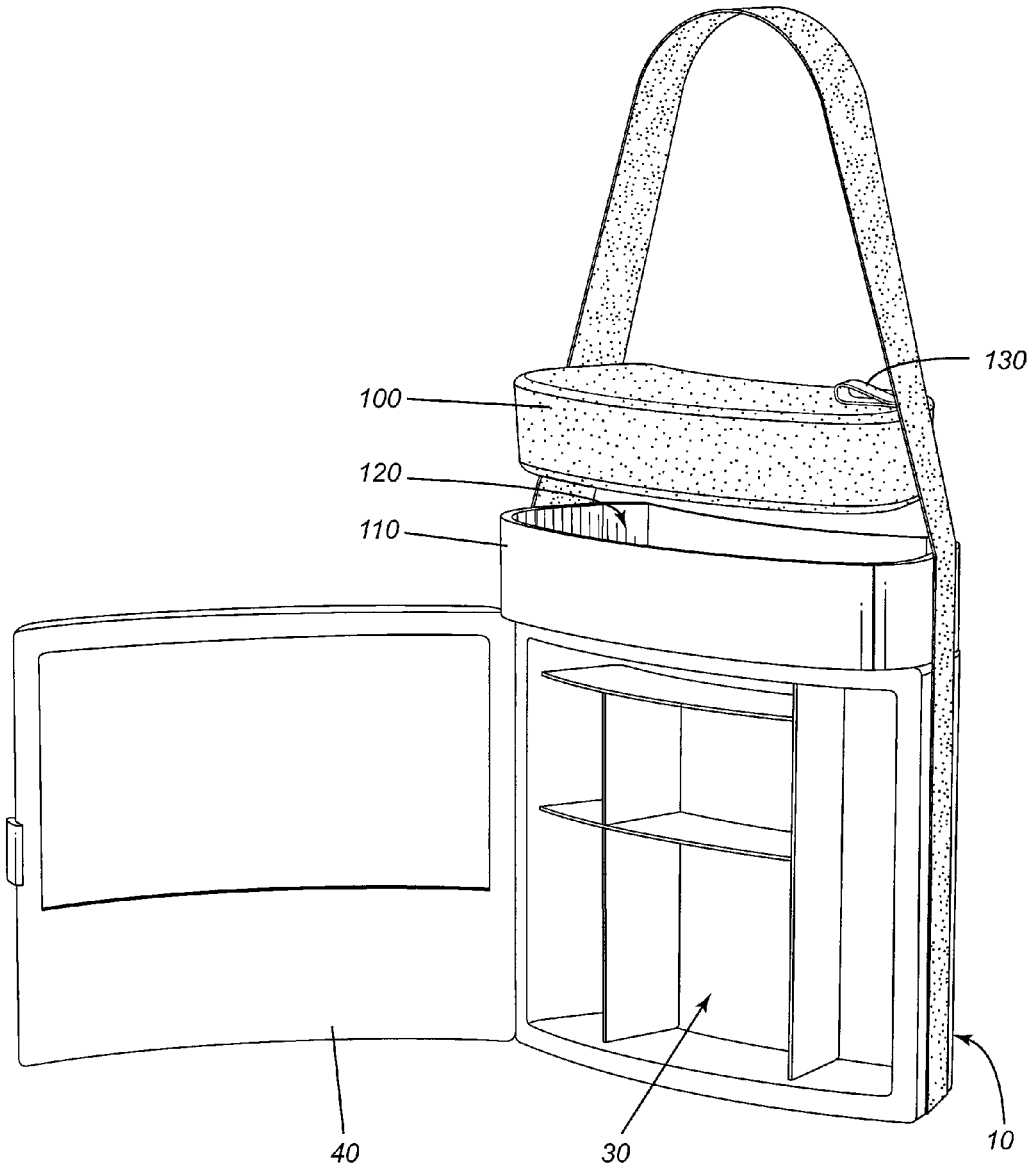
FIG. 13 is a perspective view of the cooler-purse combination shown in FIG. 9, depicted with the door swung open and with the purse removed from a receptacle atop the cooler.
Figure 14:
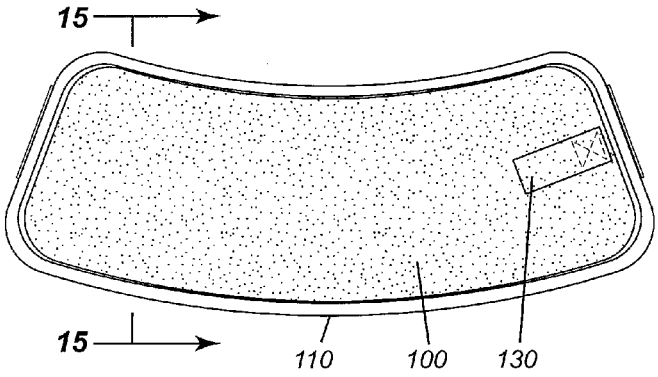
FIG. 14 is a top plan view of the cooler sitting with the receptacle formed at the top of the cooler.
Figure 15:
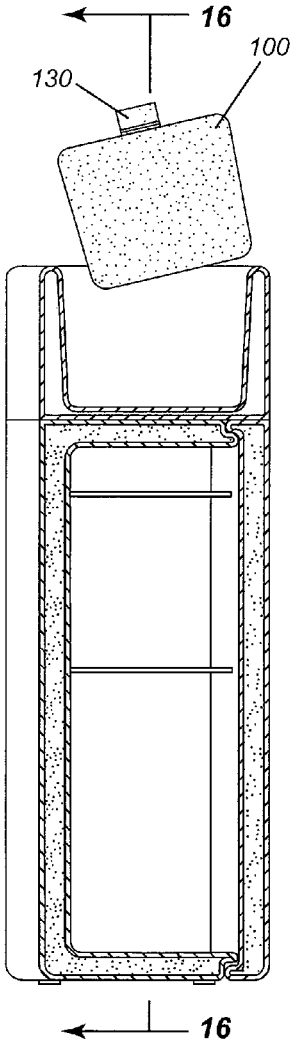
FIG. 15 is a lateral cross-sectional view of the cooler with the purse partially removed from its receptacle.
Figure 16:
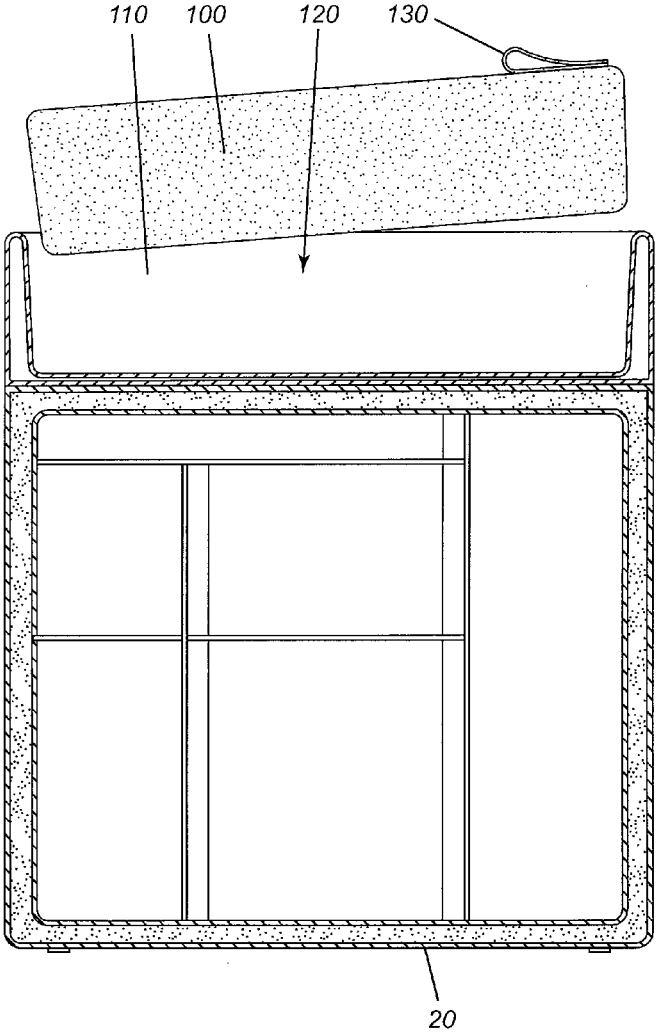
FIG. 16 is a frontal cross-sectional view of the cooler with the purse partially removed from its receptacle.
Figure 17:
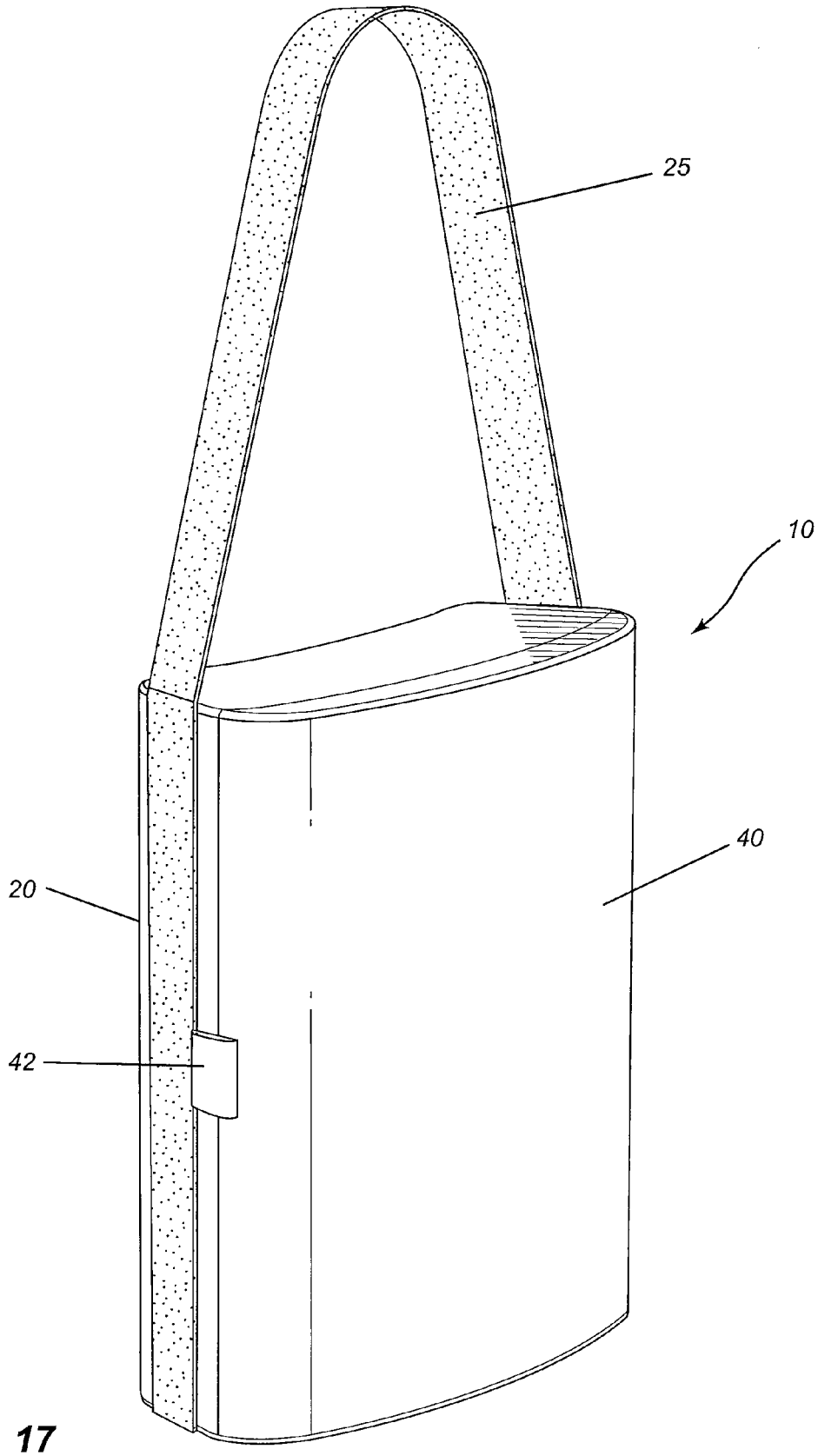
FIG. 17 is a perspective view of an elongated cooler in accordance with another embodiment of the present invention.
Figure 18:
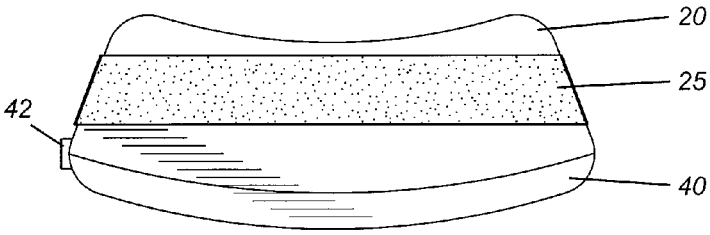
FIG. 18 is a top plan view of the cooler of FIG. 17.
Figure 19:
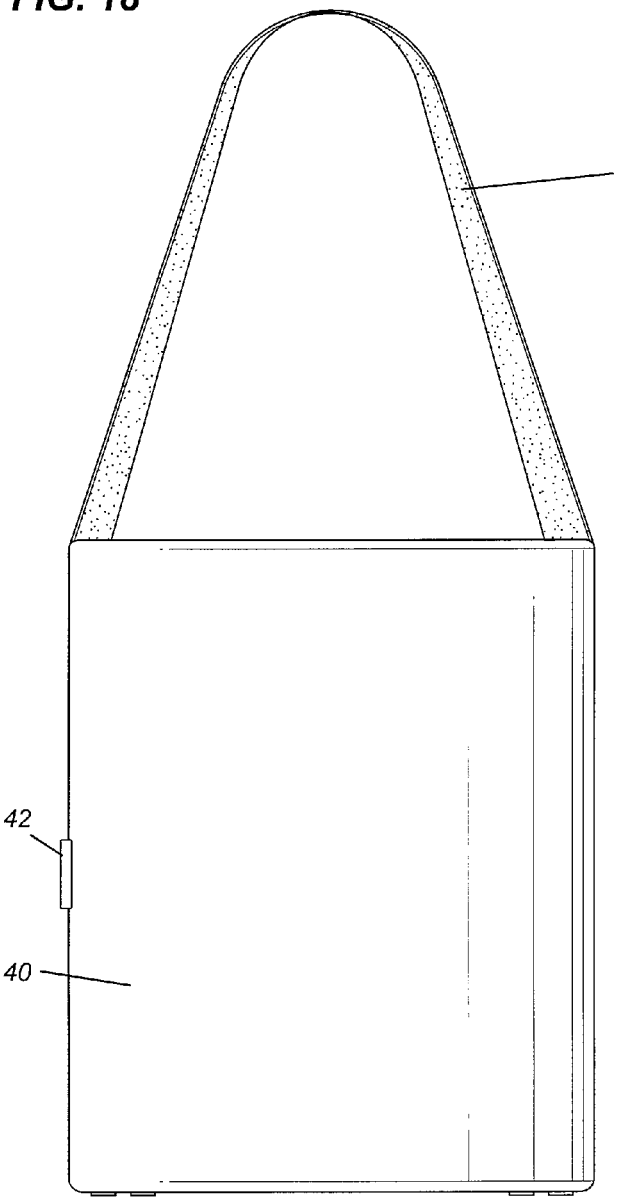
FIG. 19 is a front elevation view of the cooler of FIG. 17.
Figure 20:
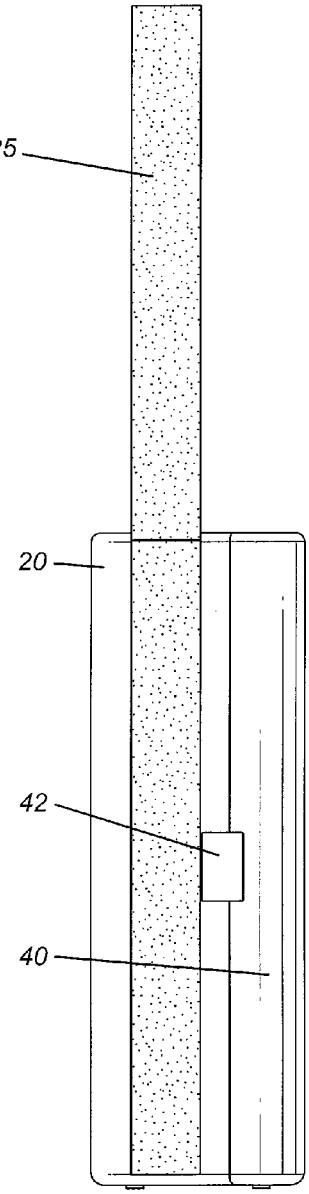
FIG. 20 is a side elevation view of the cooler of FIG. 17.
Figure 21:
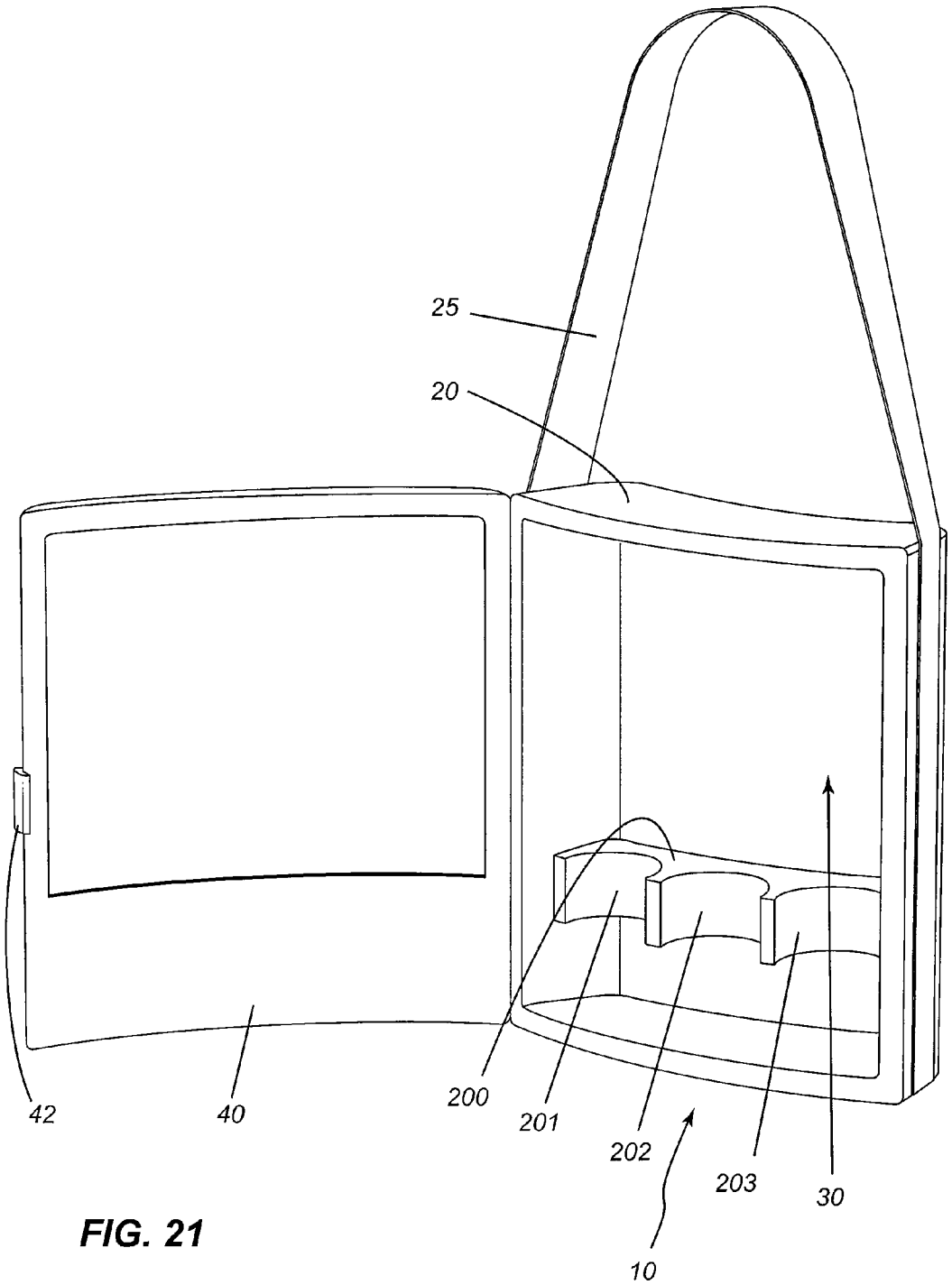
FIG. 21 is a perspective view of the cooler of FIG. 17, depicted with the door open, revealing a multiple-bottle-holding compartment.
Figure 22:
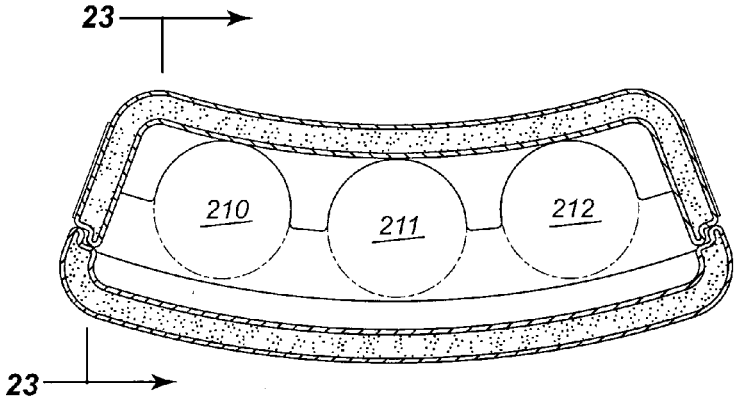
FIG. 22 is a partial cross-sectional view showing from above three bottles in stippled lines held within the cooler of FIG. 17.
Figure 23:
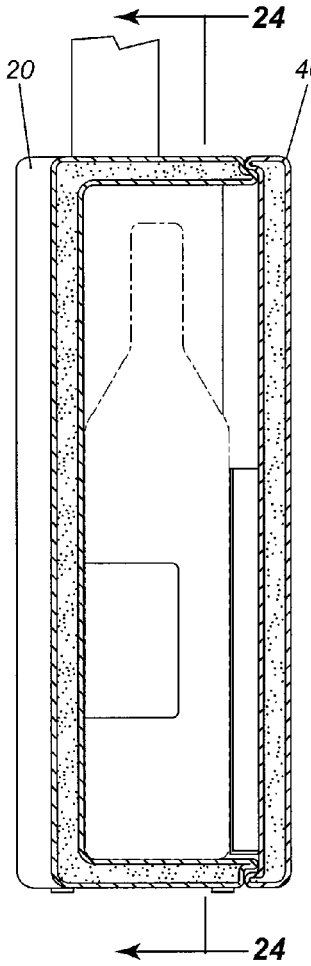
FIG. 23 is a lateral partial cross-sectional view showing a bottle held by the moulded bottle holder.
Figure 24:
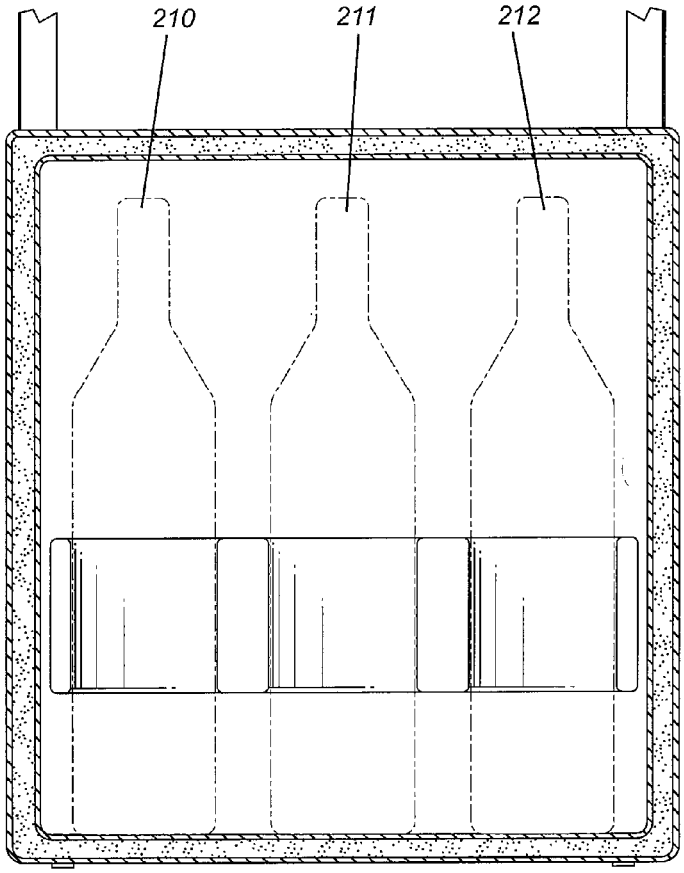
FIG. 24 is a frontal partial cross-sectional view showing three bottles held by the moulded bottle holder.

Optionally, as best seen in FIG. 13 and FIGS. 15-16, the outer shell 20 of the cooler 10 has an upper extension 110 defining a receptacle 120 shaped to house the detachable purse 100. As depicted by way of example, the upper extension that forms that receptacle 120 that can be mounted atop the shell 20, e.g. affixed atop the shell or, alternatively, it can be moulded integrally with the shell. In other words, the upper extension that forms the receptacle can be fastened, bonded or otherwise attached to the top of the cooler. It is also possible to integrally mould the outer shell to include the upper extension such that the top of the outer shell defines a socket or receptacle for receiving the purse. In one set of embodiments, as depicted by way of example, this moulded receptacle 120 can be shaped to snugly receive the detachable purse 100. The purse can have a pull tab or pull strap 130 to enable extraction of the purse 100 from the receptacle 120, as shown in FIGS. 15 and 16. In other words, the detachable purse has a shape complementary to a shape of the receptacle to enable the purse to be snugly inserted or fitted into the receptacle. In addition to, or in lieu of, the snug fit of the purse inside the receptacle, the purse can alternatively be detachably mounted to the cooler portion using a zipper, Velcro™, snaps, buttons, magnets, interlocking clips, combinations thereof, or any other mechanical means known in the art. Optionally, a locking mechanism can be provided to enable the user to lock the purse to the rest of the cooler to inhibit theft or "purse-snatching".

Optionally, as was the case with the first embodiment, the rear panel (and front panel, i.e. the door) of the cooler can be curved for both aesthetic reasons and comfortable wearing.

As was also the case with the first embodiment presented above, the internal compartment of the cooler portion can optionally have a plurality of reconfigurable dividers that can be repositioned to customize the internal compartment. Similarly, the purse may have internal compartments. The internal compartments are arranged to accommodate, for example, various boxes or containers and an upright bottle as well. The purse can be used to store valuables that are not to be cooled, such as, for example, a wallet, money, credit cards, keys, a cell phone, cosmetics, a passport, tickets, or other important documents, etc. These items are stored in the purse above the cooler portion to avoid wasting the limited cooling resources and to avoid condensation or moisture from potentially damaging these items. The purse can be easily detached from the cooler portion in the event that the user wishes to keep valuables close at hand.

Third Embodiment: Elongated Cooler

An elongated variant of the cooler 10 is presented by way of example in FIGS. 17-24. The elongated cooler 10 is designed to carry upright bottles, as will be elaborated below. Many of the components of the first and second embodiments of the cooler are found in this third embodiment. As can be seen in FIGS. 17-20, in the third embodiment, the cooler has an outer shell 20, a door 40, a shoulder strap 25, a locking clip 42, as were found in the previous embodiments.

In the embodiment depicted in FIGS. 17-24, the interior (or internal compartment) 30 of the cooler 10 is designed to accommodate, for example, three upright bottles 210, 211, 212, as best seen in FIGS. 21-24 The cooler 10 can, of course, be scaled to accommodate any number of bottles or bottles of different sizes and shapes. A shelf can be added to store bottles in rows. As shown in FIGS. 21-24, the cooler 10 may comprise a moulded bottle holder 200 attached to the inside back wall for securely holding bottles inside the cooler and for preventing these bottles from rattling into one another when the cooler is carried around. The moulded bottle holder 200 may have curved receiving portions 200, 201, 202 that are moulded with a curvature complementary to that of a typical wine bottle, water bottle, or any other desired bottle. Optionally, a strap or band can be provided to further secure the bottles in place. As another alternative, the inside of the door can have its own moulded bottle holder that closes onto the bottles to further secure the bottles in place. This particular embodiment is particularly well-suited for carrying bottles (e.g. bottles of wine or other beverages) to, for instance, a dinner party, lunch, barbecue, get-together, etc., where it is desired to arrive at the event with cold, or at least cool, drinks to offer.

As will be noted, there is no top shelf in the interior 30 of the cooler presented in FIGS. 17-24. Therefore, this embodiment does not provide a space for an ice pack or gel pack. This is deliberate, to illustrate that the gel pack or ice pack (and its dedicated shelf or compartment) is optional since the drinks can merely be chilled prior to transport. Optionally, however, the cooler presented in FIGS. 17-24 can be modified to include a shelf or compartment for receiving an ice pack or gel pack. In one possible arrangement, the gel packs can be disposed in the spaces or gaps between the adjacent bottles.

As will be appreciated, the specific interior arrangements of the coolers depicted in these figures are presented solely by way of example. Other interior configurations or arrangements can be provided without departing from the scope of the present invention.

Each of the embodiments presented in FIGS. 1 to 24 show, by way of example, a shoulder strap for carrying the cooler (or cooler-purse combination). The shoulder strap can optionally include a padded shoulder cushion to make the cooler more comfortable to carry. Other straps, harnesses, handles can be affixed to the cooler in addition to, or in lieu of, the shoulder strap. Therefore, the cooler can be carried in other embodiments as a backpack, carried as a briefcase, rolled along as a suitcase with a telescopic handle, etc. The cooler may optionally also have a plurality of different foldaway straps, handles, etc. that can be unfolded or extended for carrying the cooler in one of different modes, depending on the user's wishes.

Various modifications of form, arrangement of components, steps, details and order of operations of the embodiments illustrated, as well as other embodiments of the invention, will be apparent to persons skilled in the art upon reference to this description. It is therefore contemplated that the appended claims will cover such modifications and embodiments as fall within the true scope of the invention as set forth in the claims. In the specification including the claims, any numeric ranges are inclusive of the numbers defining the range. Citation of references herein shall not be construed as an admission that such references are prior art to the present invention. Accordingly, the embodiments of the invention described above are intended to be exemplary only. The scope of the invention is therefore intended to be limited solely by the appended claims.

The invention claimed is:

1. A cooler comprising:

a thermally isolating outer shell defining an internal compartment for holding contents to be kept cool, the outer shell comprising:

a base;

a rear panel extending upwardly from the base;

a pair of side walls extending upwardly from the base on opposite sides thereof, each side wall having a rear surface engaged to the rear panel and a front surface; and a top surface connected to a top of the rear panel and extending between respective top surfaces of the pair of side walls, the top surface forming the uppermost surface of the cooler;

a door connected to the outer shell for providing access to the internal compartment, wherein the door is hingedly connected to the front surface of one of the side walls and detachably connected to the front surface of the other side wall, the door extending entirely from the base to a front portion of the top surface;

a receptacle fastened to the top surface of the thermally isolating outer shell, the receptacle comprising a plurality of sidewalls extending upwardly from the top surface of the outer shell and terminating in a top lip defining a periphery such that the receptacle is open at the top thereof; and a detachable purse shaped to fit within the receptacle, wherein the purse is not enclosed when fitted within the receptacle and is easily accessible by a user.

2. The cooler as claimed in claim 1 wherein the detachable purse has a shape complementary to a shape of the receptacle to enable the purse to be snugly inserted into the receptacle, the purse comprising a pull strap to enable extraction of the purse from the receptacle.

3. The cooler as claimed in claim 1 wherein the thermally isolating outer shell is curved for ergonomically fitting over a hip of a user when the cooler is worn on a shoulder of the user, wherein the door is also curved to match the curved outer shell.

4. The cooler as claimed in claim 1 wherein the internal compartment comprises a top shelf for holding a gel pack and a plurality of dividers defining compartments beneath the top shelf.

5. The cooler as claimed in claim 1 wherein the internal compartment comprises a plurality of reconfigurable dividers that can be repositioned to provide a plurality of different configurations for holding variously sized contents.

6. The cooler as claimed in claim 1 wherein the internal compartment comprises a moulded bottle holder affixed to an inside wall of the shell for holding a plurality of bottles in a parallel and spaced-apart relationship.

7. The cooler as claimed in claim 1 further comprising an adjustable shoulder strap that is connected to each side of the outer shell.

8. A purse-cooler combination comprising:

a thermally isolating cooler having an outer shell defining an internal compartment and a door connected to the outer shell for providing access to the internal compartment, wherein the outer shell comprises:

a base and a rear panel extending upwardly from the base;

a pair of side walls extending upwardly from the base on opposite sides thereof, each side wall having a rear surface engaged to the rear panel and a front surface; and a top surface connected to a top of the rear panel and extending between respective top surfaces of the pair of side walls, the top surface forming the uppermost surface of the cooler;

a receptacle fastened to the top surface of the thermally isolating cooler, the receptacle comprising a plurality of sidewalls extending upwardly from the top surface of the outer shell and terminating in a top lip defining a periphery such that the receptacle is open at the top thereof; and a detachable purse shaped to fit within the receptacle, wherein the purse is not enclosed when fitted within the receptacle and is easily accessible by a user; and wherein the door is hingedly connected to the front surface of one of the side walls and detachably connected to the front surface of the other side wall, the door extending entirely from the base to a front portion of the top surface.

9. The purse-cooler combination as claimed in claim 8 wherein the outer shell of the cooler comprises an upper extension defining the receptacle.

10. The purse-cooler combination as claimed in claim 8 wherein the internal compartment comprises a plurality of reconfigurable dividers that can be repositioned to customize the internal compartment.

11. The purse-cooler combination as claimed in claim 9 wherein the internal compartment comprises a plurality of reconfigurable dividers that can be repositioned to customize the internal compartment.

12. The purse-cooler combination as claimed in claim 8 wherein the rear panel of the cooler is curved and wherein the door of the cooler is similarly curved.

13. The purse-cooler combination as claimed in claim 9 wherein the rear panel of the cooler is curved and wherein the door of the cooler is similarly curved.

14. The purse-cooler combination as claimed in claim 10 wherein the rear panel of the cooler is curved and wherein the door of the cooler is similarly curved.

15. The purse-cooler combination as claimed in claim 11 wherein the rear panel of the cooler is curved and wherein the door of the cooler is similarly curved.

* * * * *